US005370144A

United States Patent [19]

Yang

[11] Patent Number: 5,370,144

[45] Date of Patent: Dec. 6, 1994

[54] MULTIPLE-FOLD MINI UMBRELLA WITH CENTRALIZED RETRACTION

[76] Inventor: Chi-Kuo Yang, c/o Hung Hsing Patent Service Center, P.O. Box 55-1670, Taipei, Taiwan, Prov. of China

[21] Appl. No.: 248,221

[22] Filed: May 24, 1994

[51] Int. Cl.[5] ..... A45B 19/00

[52] U.S. Cl. ..... 135/25.31; 135/26; 135/31

[58] Field of Search ..... 135/25.1, 25.3, 25.31, 135/26, 29, 31

[56] References Cited

U.S. PATENT DOCUMENTS 973,155 10/1910 Woollett ..... 135/29 X
4,610,262 9/1986 Broyer et al. ..... 135/31 X
5,305,770 4/1994 DeMarco ..... 135/25.31 X

FOREIGN PATENT DOCUMENTS 1113067 8/1961 Germany ..... 135/29

*Primary Examiner*—Lanna Mai

[57] ABSTRACT

A multiple-fold mini umbrella includes: a telescopic central shaft, and at least a top rib pivotally secured to an upper notch formed on a top end of the central shaft, a stretcher rib pivotally connected between each top rib and a middle runner, and an auxiliary stretcher rib pivotally connected to a lower runner slidably disposed about the central shaft with the middle runner slidably engageable with a sleeve member of the lower runner having an upper flange formed on a top edge of the sleeve member, and an intermediate rib slidably engageable with the auxiliary stretcher rib and pivotally connected with an outer rib which is pivotally connected to the top rib by a linking rod, whereby when closing an opened umbrella by lowering the lower runner along the central shaft to lower the auxiliary stretcher rib toward the central shaft, the upper flange of the lower runner will pull the middle runner and the pivotally connected stretcher rib and top rib downwardly to retractively centralize all the umbrella ribs toward the central shaft to greatly reduce a folding volume of the closed umbrella for a convenient carrying purpose.

2 Claims, 5 Drawing Sheets

MULTIPLE-FOLD MINI UMBRELLA WITH CENTRALIZED RETRACTION

BACKGROUND OF THE INVENTION

A conventional multiple-fold umbrella as shown in FIGS. 1, 2 comprises: a telescopic central shaft 1, and an umbrella rib means 2 pivotally mounted to the central shaft 1 for securing an umbrella cloth 3 on the rib means 2, including at least a top rib 21 pivotally connected between an upper notch 11 formed on a top end of the shaft 1 and an intermediate rib 24, a stretcher rib 22 having its inner rib end 221 pivotally secured to a lower runner 23 slidably held on the central shaft 1 and retained on a spring catch 12 of the central shaft 1 when opening the umbrella as shown in FIG. 1 and having an outer rib end 222 of the stretcher rib 22 pivotally connected with the top rib 21, an auxiliary stretcher rod 25 having its inner rod end 251 pivotally secured to the inner rib end 221 of the stretcher rib 22 and having an outer rod end 252 slidably engageable with a longitudinal groove recessed in the intermediate rib 24, an outer rib 27 pivotally secured to an outer end of the intermediate rib 24, and a linking rod 28 generally parallel to the intermediate rib 24 and pivotally connecting the top rib 21 and the outer rib 27.

When folding the umbrella from FIG. 1 to FIG. 2, the catch 12 is depressed inwardly and the runner 23 is lowered along the central shaft 1 to retract the rib means 2 inwardly in order to reduce a volume of the umbrella for convenient carrying purpose. However, since the lower runner 23 can only move a small stroke "S" on the shaft 1 from an opened umbrella (FIG. 1) to a closed umbrella (FIG. 2), both the auxiliary stretcher rib 25 as pivotally secured to the top rib 21 and the intermediate rib 24 as slidably engageable with the auxiliary stretcher rib 25 are still horizontally positioned as shown in FIG. 2, and are not centralized or greatly folded towards the central shaft, thereby still occupying a big space by the umbrella ribs 2 and cloth 3 and influencing a compact appearance of the multiple-fold umbrella.

SUMMARY OF THE INVENTION

The object of the present invention is to provide a multiple-fold mini umbrella including: a telescopic central shaft, and at least a top rib pivotally secured to an upper notch formed on a top end of the central shaft, a stretcher rib pivotally connected between each top rib and a middle runner, and an auxiliary stretcher rib pivotally connected to a lower runner slidably disposed about the central shaft with the middle runner slidably engageable with a sleeve member of the lower runner having an upper flange formed on a top edge of the sleeve member, and an intermediate rib slidably engageable with the auxiliary stretcher rib and pivotally connected with an outer rib which is pivotally connected to the top rib by a linking rod, whereby when closing an opened umbrella by lowering the lower runner along the central shaft to lower the auxiliary stretcher rib toward the central shaft, the upper flange of the lower runner will pull the middle runner and the pivotally connected stretcher rib and top rib downwardly to retractively centralize all the umbrella ribs toward the central shaft to greatly reduce a folding volume of the closed umbrella for a convenient carrying purpose.

DETAILED DESCRIPTION

Figures 7, 8:
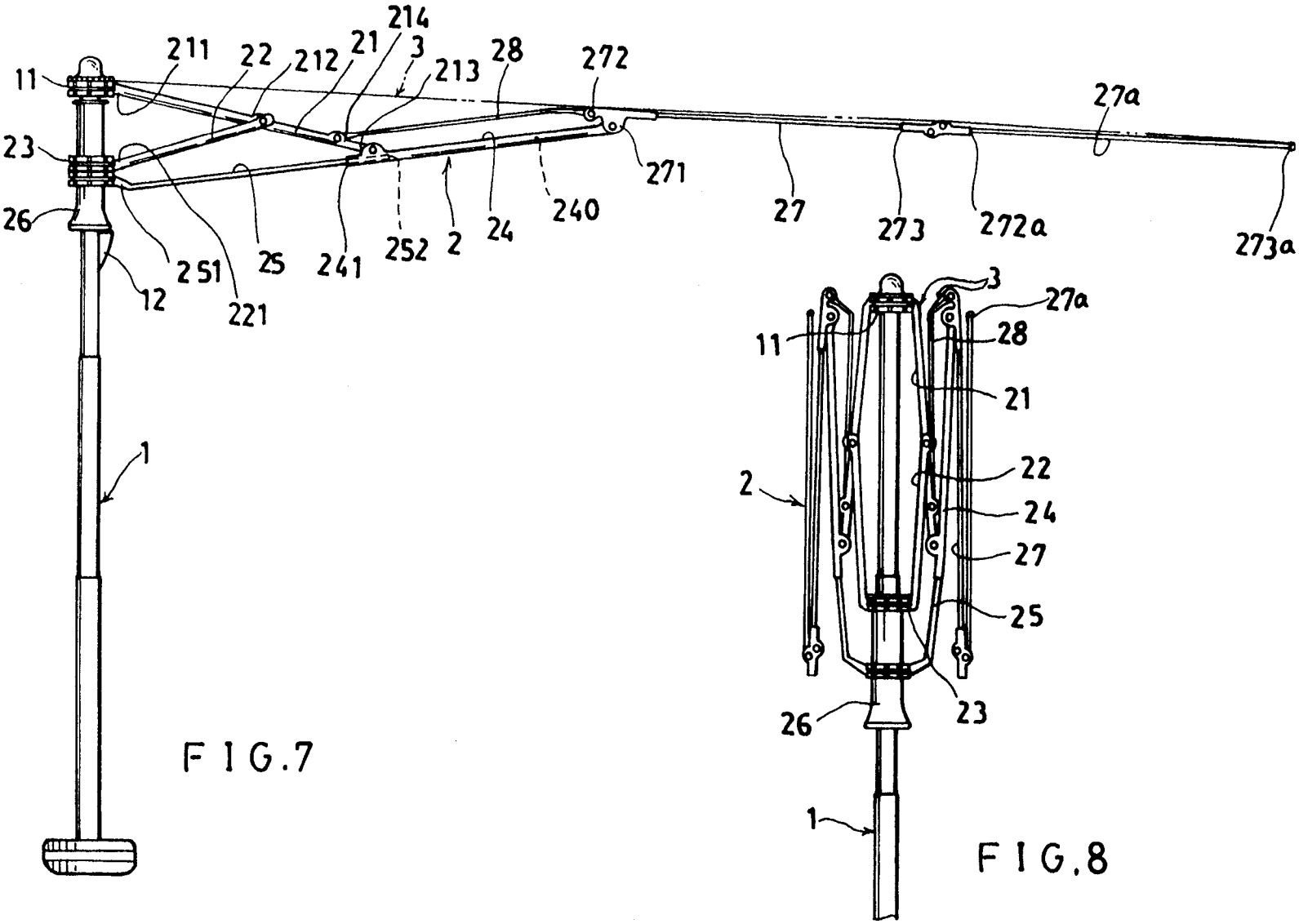
FIG. 7 shows an opened quaternary-fold umbrella of another preferred embodiment of the present invention.
FIG. 8 shows a folded umbrella from FIG. 7.

As shown in FIGS. 3–6, the present invention comprises: a telescopic central shaft 1, and an umbrella rib means 2 pivotally secured to the central shaft 1 having an umbrella cloth 3 secured on the rib means 2. The central shaft 1 has an upper notch 11 formed on a top end portion of the shaft 1, and a spring catch 12 resiliently retained on an upper portion of the central shaft 1. The telescopic central shaft 1 includes a plurality of tubular sections telescopically engageable, retractable, and extendible with one another about a shaft axis 10 longitudinally defined at a center of the shaft 1. The umbrella rib means 2 consists of a plurality of ribs such as numerals 21, 22, 24, 25, 27, 28, etc., of which the number of ribs are not limited in this invention. As shown in FIGS. 3–6, the rib means 2 is provided for a triple-fold umbrella, while another preferred embodiment of this invention as shown in FIGS. 7, 8 shows a quaternary-fold umbrella. Other modifications may be made without departing from the spirit and scope of this invention.

The umbrella rib means 2 includes: at least a top rib 21 having an inner end portion 211 of the top rib 21 pivotally secured to the upper notch 11 formed on a top end portion of the central shaft 1, a stretcher rib 22 having an inner end portion 221 of the stretcher rib 22 pivotally connected to a middle runner 23 and having an outer end portion 222 of the stretcher rib 22 pivotally connected to a middle rib portion 212 of the top rib 21, an intermediate rib 24 having a rib groove 240 longitudinally recessed in the intermediate rib 24 with a cross section of the rib groove 240 generally U shaped for slidably engaging an auxiliary stretcher rod 25 in the rib groove 240 of the intermediate rib 24 having an inner end portion 241 of the intermediate rib 24 pivotally connected with an outermost end portion 213 of the top rib 21 and slidably receiving an outer end portion 252 of the auxiliary stretcher rod 25, the auxiliary stretcher rod 25 having an inner end portion 251 of the auxiliary stretcher rib 25 pivotally connected to a lower runner 26 slidably held on the central shaft 1, an outer rib 27 having an inner end portion 271 of the outer rib 27 pivotally connected to an outer end portion 242 of the intermediate rib 24 and having an outer end portion 273 secured to an outer periphery of the umbrella cloth 3 also secured to the upper notch 11 and the top rib 21, and a linking rod 28 generally parallel to the intermediate rib 24 having an inner end portion 281 of the linking rod 28 pivotally secured to an outer end portion 214 of the top rib 21 next to the outermost end portion 213 of the top rib 21 and having all outer end portion 282 of the linking rod 28 pivotally connected to an innermost end portion 272 of the outer rib 27 adjacent to the inner end portion 271 of the outer rib 27.

The lower runner 26 includes: a sleeve member 261 slidably held on the central shaft 1 and having a lower flange 260 circumferentially formed on a lowest edge portion of the sleeve member 261, a lower ferrule 262 circumferentially secured on a lower portion of the sleeve member 261 for pivotally connecting the inner end portion 251 of each auxiliary stretcher rod 25, and an upper flange 263 circumferentially formed on a top edge portion of the sleeve member 261.

The middle runner 23 includes a middle ferrule 231 pivotally secured with an inner end portion 221 of each stretcher rib 22 and formed with a central opening 232 in the middle ferrule 231, with the central opening of the middle ferrule 231 engageable with the sleeve member 261 of the lower runner 26.

Figure 1:
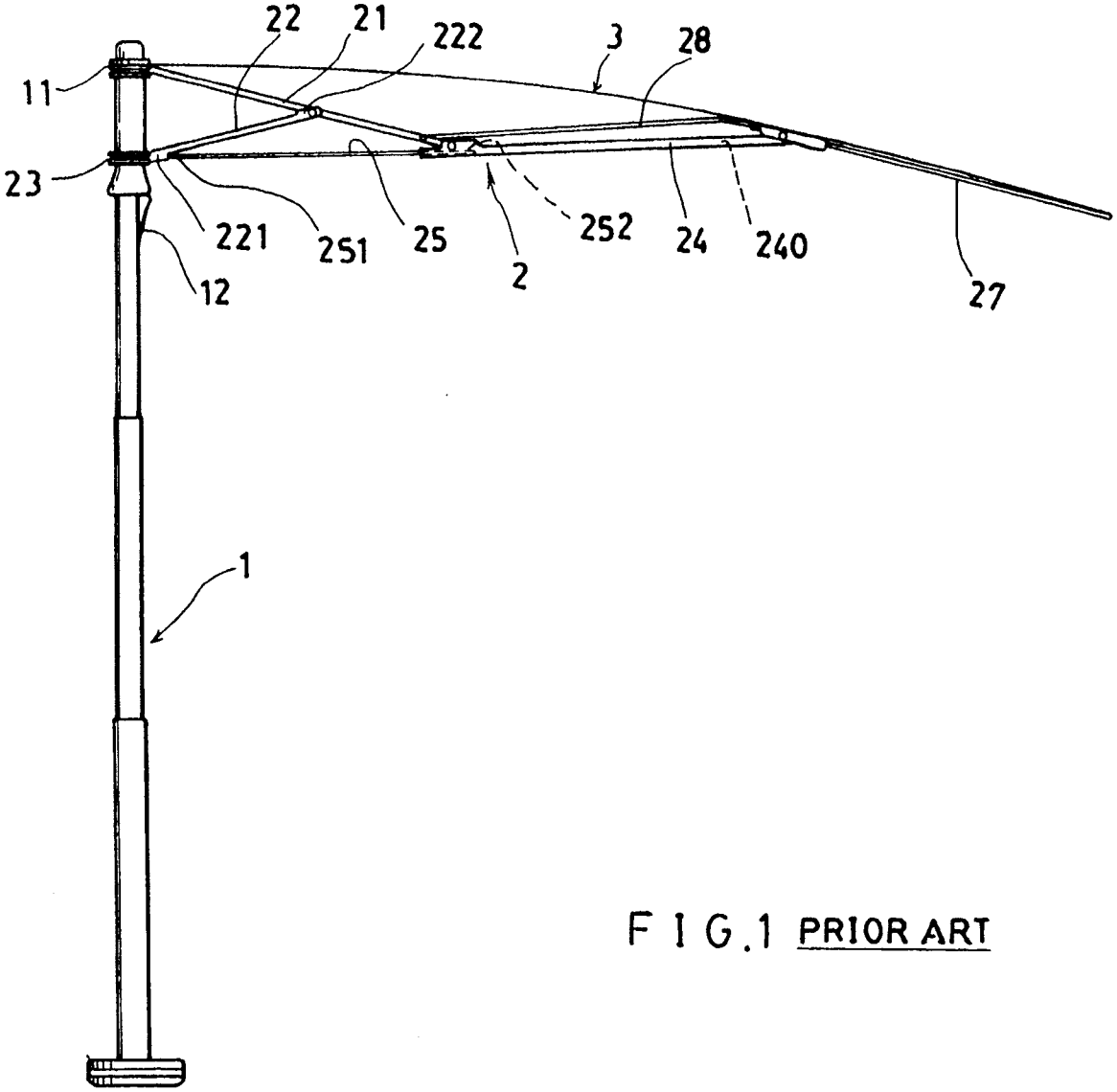
FIG. 1 PRIOR ART
FIG. 1 shows an opened conventional multiple-fold umbrella.
Figure 2:
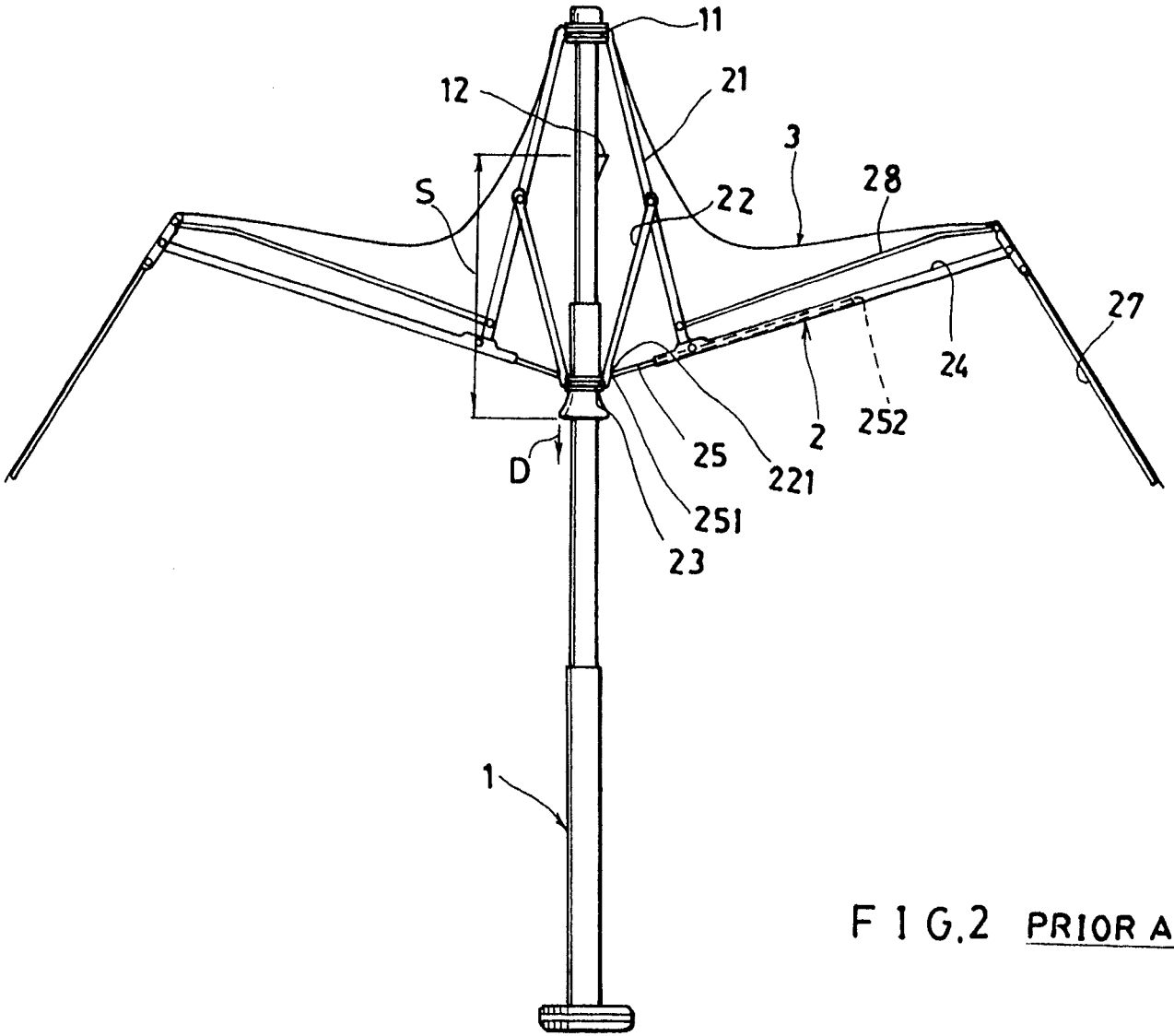
FIG.2 PRIOR ART
FIG. 2 shows the conventional umbrella when folded from FIG. 1.
Figure 3:
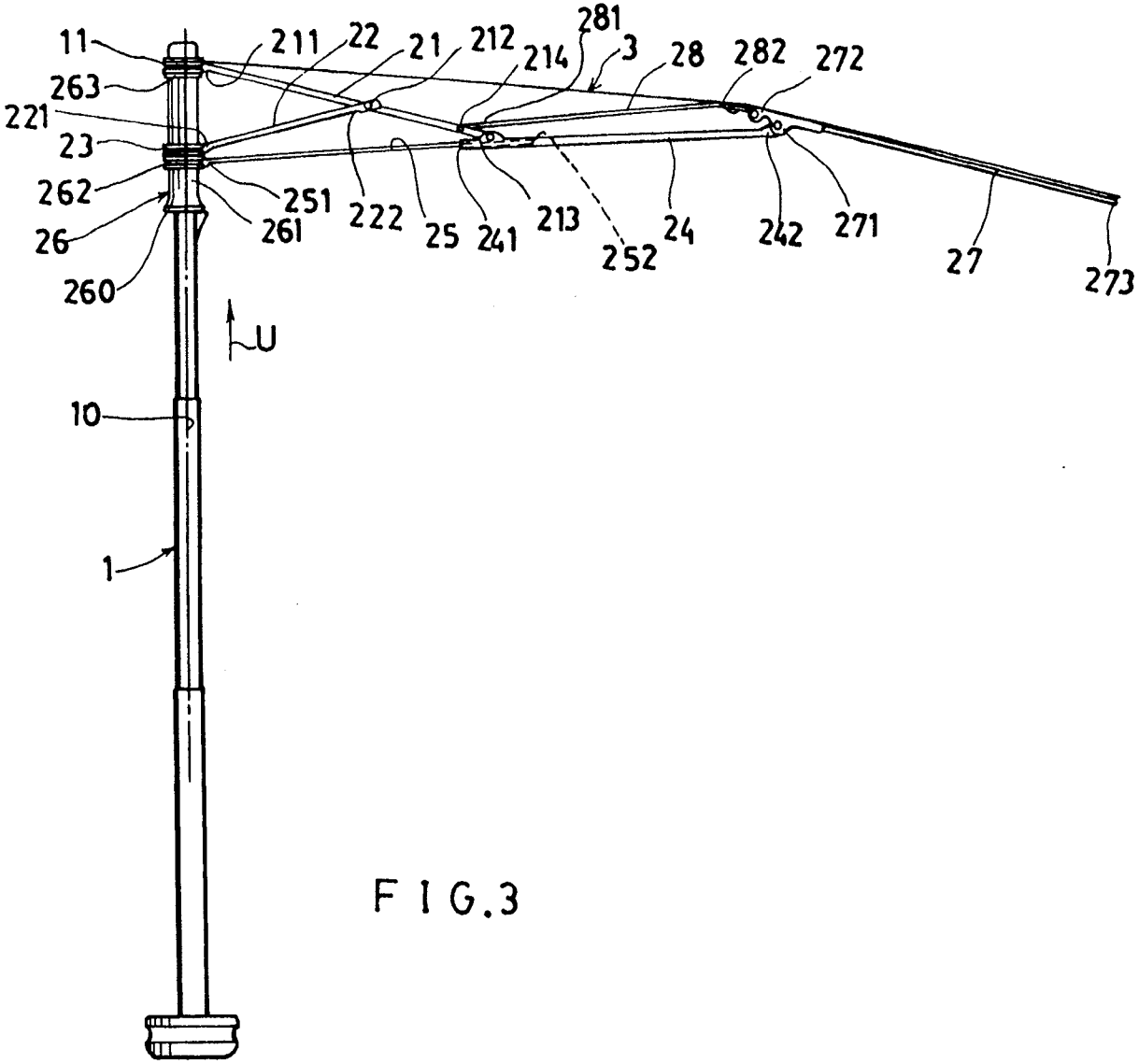
FIG. 3 is an illustration showing an opened umbrella of the present invention.

When extending the umbrella rib means 2 of the present invention, the lower runner 26 is pushed upwardly U to allow the lower ferrule 262 to urge the middle ferrule 231 of the middle runner 23 upwardly along the central shaft 1 to thereby extend the stretcher rib 22, the top rib 21 upwardly outwardly (radially) in order to extend the intermediate rib 24 from the stretcher rod 25, and finally extend the outer rib 27 and linking rod 28 upwardly outwardly until the umbrella is opened as shown in FIG. 3. The upper flange 263 is retarded against the upper notch 11 and the lower flange 260 of the lower runner 26 is then retained and locked on the catch 12 for stably opening the umbrella.

Figure 5:
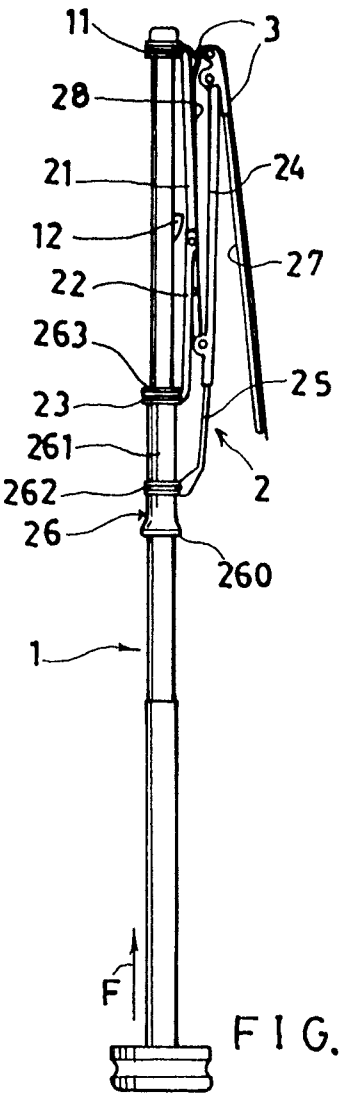
FIG. 5 shows a folded compact umbrella of the present invention following the situation of FIG. 4.
Figure 6:
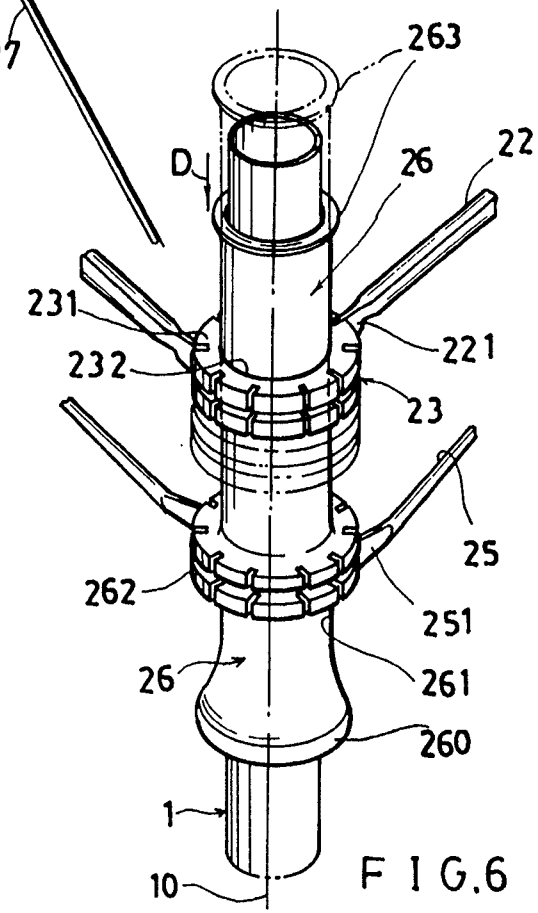
FIG. 6 is a partial perspective view showing the middle and lower runners of the present invention.
Figure 4:
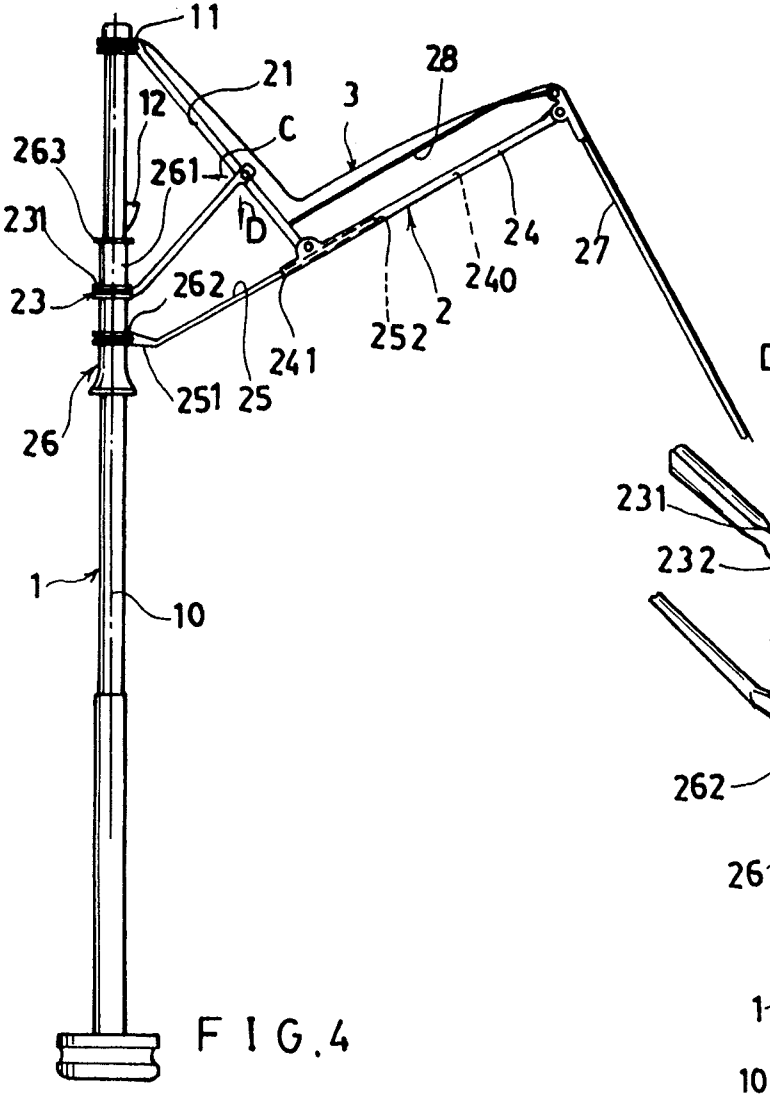
FIG. 4 shows a folding umbrella when folded from FIG. 3 in accordance with the present invention.

Upon a depression of the catch 12 and lowering (D) the lower runner 26 to allow the upper flange 263 to pull the middle ferrule 231 of the middle runner 23 downwardly, the stretcher rib 22 will be simultaneously pulled downwardly and centralized (C) towards the shaft axis 10 of the central shaft 1 as shown in FIGS. 4, 5 and 6, and the top rib 21 as pivotally connected with the stretcher rib 22 will also be retracted toward the central shaft 1 to push the intermediate rib 24 to "receive" the auxiliary stretcher rod 25 into the groove 240 in the intermediate rib 24, and the outer rib 27 pivotally secured to the top rib 21 by means of the linking rod 28 will then also be folded inwardly towards the central shaft 1, thereby folding the umbrella from its opening state as shown in FIG. 3 to a fully closed state as shown in FIG. 5 to greatly minimize the folded volume of the umbrella for convenient carrying purpose and providing a mini compact appearance of the folded umbrella. By further folding and retracting (F) the telescopic tubular sections of the central shaft 1, a shortened miniature folded umbrella will be obtained.

As shown in FIGS. 7, 8, an auxiliary outer rib **27*a* may be further extendibly connected with the outer rib 27 by pivotally connecting the outer end portion 273 of the outer rib 27 with an inner end portion 272*a* of the auxiliary outer rib 27*a*, and an outer end portion 273*a* of the auxiliary outer rib 27*a* is secured with an outer periphery of the umbrella cloth 3**. By the way, a quaternary-fold umbrella may be obtained for a multiple-fold umbrella.

The lower ferrule 262 is integrally formed with the sleeve member 261 of the lower runner 26 of the present invention. By the mutual slidable engagement of the middle and the lower runners 23, 26 in accordance with the present invention, the umbrella ribs 2 as pivotally connected with the two runners 23, 26 will be folded and centralized to approach the central shaft 1 as near as possible, thereby greatly reducing a folded volume of the umbrella to be superior to a conventional umbrella.

I claim:

1. A multiple-fold umbrella comprising:

a telescopic central shaft consisting of a plurality of tubular sections telescopically retractable and extendible with one another, and an umbrella rib means (2) including: at least a top rib (21) pivotally secured to the upper notch (11) formed on a top end portion of the central shaft (1), a stretcher rib (22) pivotally connected to a middle runner (23) and pivotally connected to the top rib (21), an intermediate rib (24) pivotally connected to said top rib and having a rib groove (240) longitudinally recessed at one end; said rib groove having a cross section of generally U-shaped to slidably engage an auxiliary stretcher rod (25) in that said rib groove (240) slidably receiving an outer end portion (252) of the auxiliary stretcher rod (25), the auxiliary stretcher rod (25) pivotally connected to a lower runner(26) slidably held on the central shaft (1) an outer rib (27) pivotally connected to the intermediate rib (24) and secured to an umbrella cloth (3) which is secured to the upper notch (11) and the top rib (21), and a linking rod (28) generally parallel to the intermediate rib (24) and pivotally secured to the top rib (21) and pivotally connected to the outer rib (27);

said lower runner (26) including: a sleeve member (261) slidably held on the central shaft (1) and having a lower flange (260) circumferentially formed on a lowest edge portion of the sleeve member (261), a lower ferrule (262) circumferentially secured on a lower portion of the sleeve member (261) pivotally connecting an inner end portion (251) of said auxiliary stretcher rod (25), and an upper flange (263) circumferentially formed on a top edge portion of the sleeve member (261);

and said middle runner (23) including a middle ferrule (231) pivotally secured with an inner end portion (221) of said stretcher rib (22) and formed with a central opening (232) in the middle ferrule (231), with the central opening of the middle ferrule (231) engaging the sleeve member (261) of the lower runner (26); whereby upon lowering of said lower runner (26) to allow said upper flange (263) of the lower runner (26) to downwardly pull the middle ferrule (231) of the middle runner (23), the stretcher rib (22), as pivotally connected with the middle runner (23), being pulled downwardly and centralized toward a shaft axis (10) which is longitudinally defined at a center of the central shaft (1) to thereby retract the top rib (21), the intermediate rib (24), the auxiliary stretcher rod (25), the outer rib (27) and the linking rod (28) toward the shaft axis (10) of said central shaft (1) for greatly minimizing a folded volume of the middle-fold umbrella.

2. A multiple-fold umbrella according to claim 1, wherein said outer rib (27) is pivotally connected with at least an auxiliary outer rib (**27*a*) extendible outwardly from the outer rib (27) and having an outer end portion (273*a*) of the auxiliary outer rib (27*a*) secured to an outer periphery of the umbrella cloth (3**).

* * * * *